United States Patent [19]

Zelinka et al.

[11] Patent Number: 4,741,658

[45] Date of Patent: May 3, 1988

[54] RECEPTACLE DUMPING APPARATUS AND METHOD

[75] Inventors: Robert F. Zelinka; John W. Redding, both of Roselle, Ill.

[73] Assignee: Perkins Manufacturing Company, Chicago, Ill.

[21] Appl. No.: 862,015

[22] Filed: May 12, 1986

Related U.S. Application Data

[63] Continuation of Ser. No. 572,389, Jan. 20, 1984, abandoned.

[51] Int. Cl.[4] ..... B65F 3/02

[52] U.S. Cl. ..... 414/406; 414/421; 414/558; 414/786

[58] Field of Search ..... 414/303, 406, 408, 409, 414/420, 421, 546, 555, 558, 786

[56] References Cited

U.S. PATENT DOCUMENTS

| | | | |
|---|---|---|---|
| 3,732,997 | 5/1973 | Reavis et al. | 414/406 |
| 3,738,516 | 6/1973 | Wells | 414/345 X |
| 3,804,277 | 4/1974 | Brown et al. | 414/303 |
| 3,894,642 | 7/1975 | Shive | 414/303 |
| 4,042,137 | 8/1977 | Hughes et al. | 414/409 X |
| 4,365,922 | 12/1982 | Borders | 414/406 |
| 4,422,814 | 12/1983 | Borders | 414/303 |
| 4,479,751 | 10/1984 | Wyman et al. | 414/406 |

FOREIGN PATENT DOCUMENTS

| | | | |
|---|---|---|---|
| 3024081 | 1/1981 | Fed. Rep. of Germany | 414/408 |
| 83/03242 | 9/1983 | PCT Int'l Appl. | 414/422 |

*Primary Examiner*—Robert J. Spar
*Assistant Examiner*—Stuart J. Millman
*Attorney, Agent, or Firm*—Cook, Wetzel & Egan, Ltd.

[57] ABSTRACT

A lifter for emptying a container into a cavity of a vehicle. The lifter has a first plate pivotally connected to the vehicle, and a second plate extending at an angle from the first plate. The lifter has a third plate slidably mounted on the second plate, with the third plate having a pair of hooks to grasp bars on the container. The lifter moves between a first lower position beneath the truck to a second upper position with the container located above the cavity to empty the container into the cavity.

18 Claims, 3 Drawing Sheets

FIG. 1
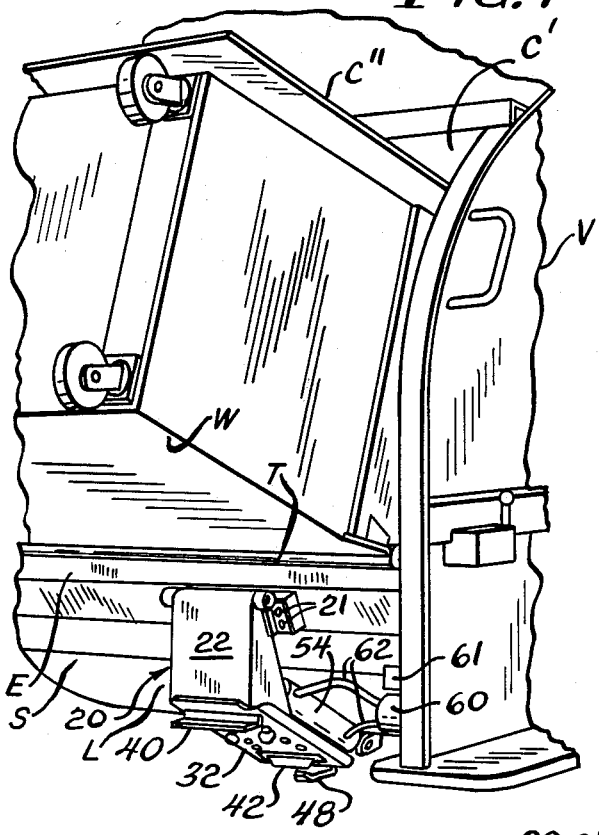
FIG. 2
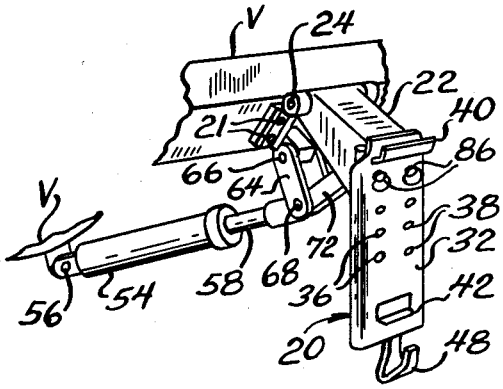
FIG. 5
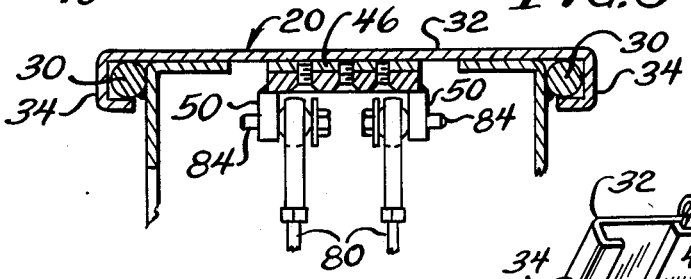
FIG. 3
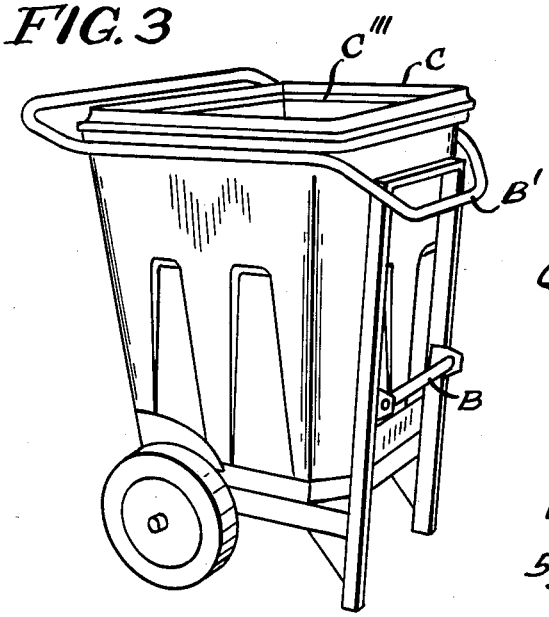
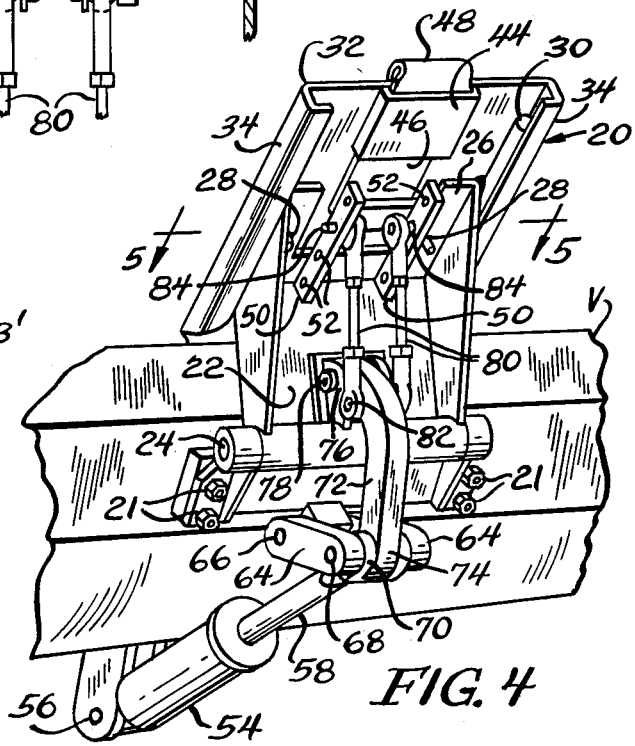
FIG. 4

RECEPTACLE DUMPING APPARATUS AND METHOD

This application is a continuation of application Ser. No. 572,389, filed Jan. 20, 1984, now abandoned.

BACKGROUND OF THE INVENTION

The present invention relates to lifting devices. Before the present invention, lifting devices have been proposed for dumping containers into the cavity of a vehicle, such as refuse trucks. An initial problem with prior devices is that they are large and cumbersome. Also, the prior lifters have prevented access to the vehicle for pivot dumping large rear loading containers. One prior device folds to a side of the vehicle to permit access to the vehicle, but the device obstructs traffic in this position.

SUMMARY OF THE INVENTION

A principal feature of the present invention is the provision of an improved lifter for emptying a container into a cavity of a vehicle which does not interfere with access for pivot dumping large rear loading containers.

In a preferred embodiment, the lifter of the present invention comprises a first plate pivotally mounted to the vehicle, and a second plate extending at an angle from the first plate. The lifter has a third plate slidably mounted on the second plate, with the third plate having a pair of second hooks. The lifter has means for driving the plates and hooks between a first lower, retracted position to a a series of second upper position.

A feature of the present invention is that in the first position the lifter is located beneath the vehicle.

Thus, a feature of the present invention is that when the lifter is at the first position access is permitted to the vehicle in order to dump a large rear loading container into the vehicle.

Another feature of the invention is that the hooks grasp bars on the container as the lifter moves between the first and second positions.

Yet another feature of the invention is that the lifter places the container above the cavity at the second position in order to empty the container into the vehicle cavity.

A further feature of the invention is that one of the hooks clamp on the container bar to prevent the container from falling into the cavity while it is being emptied.

Still another feature of the invention is that the hooks are adjustable in height on the lifter.

Thus, a further feature of the invention is that the lifter may be adjusted to accommodate changes in the truck as refuse is dumped into the vehicle or differences in height when the vehicle is located on a hill.

Further features will become more fully apparent in the following description of the embodiments of this invention and from the appended claims.

DESCRIPTION OF THE DRAWINGS

In the drawings:

FIG. 1 is a fragmentary perspective view illustrating a lifter of the present invention in a first lower position;

FIG. 2 is a fragmentary perspective view of the lifter of FIG. 1;

FIG. 3 is a perspective view of a container which is emptied into a vehicle by the lifter of the present invention;

FIG. 4 is a fragmentary perspective view of the lifter in a second upper position;

FIG. 5 is a fragmentary sectional view taken substantially as indicated along the line 5—5 of FIG. 4;

DESCRIPTION OF THE PREFERRED EMBODIMENTS

Figure 6:
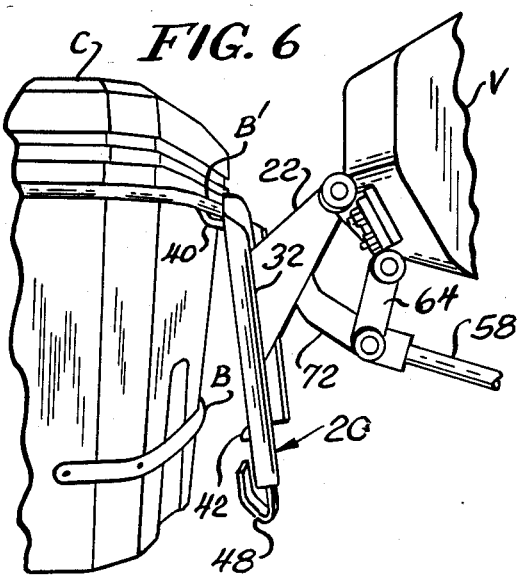
FIGS. 6–8 are fragmentary perspective views illustrating the lifter in operation to empty the containter into the vehicles.

Referring now to FIG. 1, there is shown a lifter 20 of the present invention which is mounted by bolts 21 on the rear of a vehicle V such as a refuse truck. Although the lifter 20 is shown mounted on the right rear side of the vehicle V, it will be understood that another lifter of the same type may be mounted on the left side of the vehicle V. The vehicle V has a hopper container sill S defining a lower portion of a rearwardly facing opening to the cavity C′ to receive and retain refuse. The sill S has a lower portion L slanting upwardly and rearwardly to a leading sill edge E over which the refuse is dumped. As shown FIG. 1, the lifter 20 is located at a first, or lower, position beneath the sill S of the vehicle V, with the lifter 20 being mounted by the bolts 21 adjacent but beneath the edge E of the sill S to permit horizontal access to the edge E from the edge E to the ground. The lifter 20 of the present invention is utilized to empty a first type of containers C of FIG. 3 into the cavity C′ of the vehicle V of a type which are too short to matingly engage the sill and thus must be lifted above the sill. With reference to FIG. 1, with the lifter 20 in its lower, or retracted position, the lifter 20 is located sufficiently beneath the sill S, such that access at a level vertically beneath the edge E to the ground is permitted to the sill S at the rear of the vehicle in order to empty large rear loading containers C″ of the type which are tall enough to be unloaded by tilting without lifting, as shown in FIG. 1, in a tilted position. Before and after dumping of the container C″, the front wall W of the container C″ extends substantially vertically from the sill edge E toward the ground. The container C″ has an elongated trunnion bar T at an uppermost portion of the container C″ which is located adjacent to the sill edge when the container C″ is dumped, as shown in FIG. 1. Thus, in accordance with the present invention, the lifter 20 lifts and tilts small containers without interfering with the emptying of by tilting without lifting large containers into the vehicle V.

With reference to FIG. 3, the container C with which the lifter 20 operates has a lower front bar B and an upper front bar B′. The container C has a chamber C‴ with an open top into which refuse is dumped by the user for storage until the container C is emptied into the vehicle V of FIG. 1.

With reference to FIGS. 1, 2, 4, and 5, the lifter 20 has a first plate 22 having an inner end pivotally connected at 24 to the rear of the vehicle V adjacent the cavity C′. The lifter 20 has a second plate 26 extending at an angle from an outer end of the first plate 22. The second plate 26 has a pair of spaced apertures 28 extending therethrough for a purpose which will be described below. Also, the second plate 26 has a pair of spaced rods 30 at opposed sides of the second plate 26 and extending along the second plate 26.

The lifter 20 has a third plate 32 having a pair of flanges 34 at opposed sides of the third plate 32 and partially extending around the rods 30 of the second plate 26, such that the third plate 32 is slidably mounted on the second plate 26. The third plate 32 has a first set of openings 36 aligned along the third plate 32, and a second set of openings 38 aligned along the length of the third plate 32, such that the openings 36 and 38 register with the apertures 28 of the second plate 26. The third plate 32 has an upper outwardly directed hook or hook member 40 adjacent an inner end of the third plate 32. The third plate 32 also has an outwardly directed flange 42 adjacent an outer end of the third plate 32.

The third plate 32 has an inner tunnel 44 adjacent an outer end of the third plate 32. The third plate 32 has hook means comprising a tongue 46 slidably received in the tunnel 44, and a hook or hook member 48 extending from an outer end of the tongue 46 and being directed toward the flange 42. The lifter 20 has a pair of elongated opposed flanges 50 connected to an inner end of the tongue 46, with the flanges 50 having a plurality of apertures 52 spaced along their length.

The lifter 20 has a hydraulic cylinder 54 having one end pivotally connected at 56 beneath the vehicle. The cylinder 54 has a piston 58 which may move in and out of the cylinder 54. The piston 58 of the cylinder 54 is driven by a pump 60 through conduits 62, with the pump 60 being driven by a motor 61 which is powered by the electrical system of the vehicle V.

The lifter 20 has a pair of link arms 64 having an inner end pivotally connected at 66 to the vehicle V, and outer ends pivotally connected at 68 to an outer end 70 of the piston 58. The lifter 20 has an arcuate arm 72 having one end 74 pivotally connected to the outer end 70 of the piston 58 and outer ends of link arms 64 at connection 68, and the other end 76 pivotally connected at 78 to an inner end of the first plate 22.

The lifter 20 has a pair of rods 80 having one end pivotally connected at 82 to a central portion of the arcuate arm 72 intermediate the pivotal connections 68 and 78. The other ends of the rods 80 have pins 84 which are pivotally received in selected apertures 52 of the flanges 50.

Figure 7:
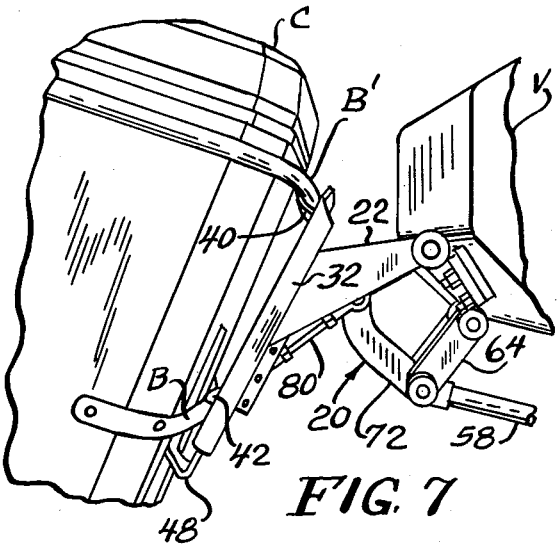
Figure 8:
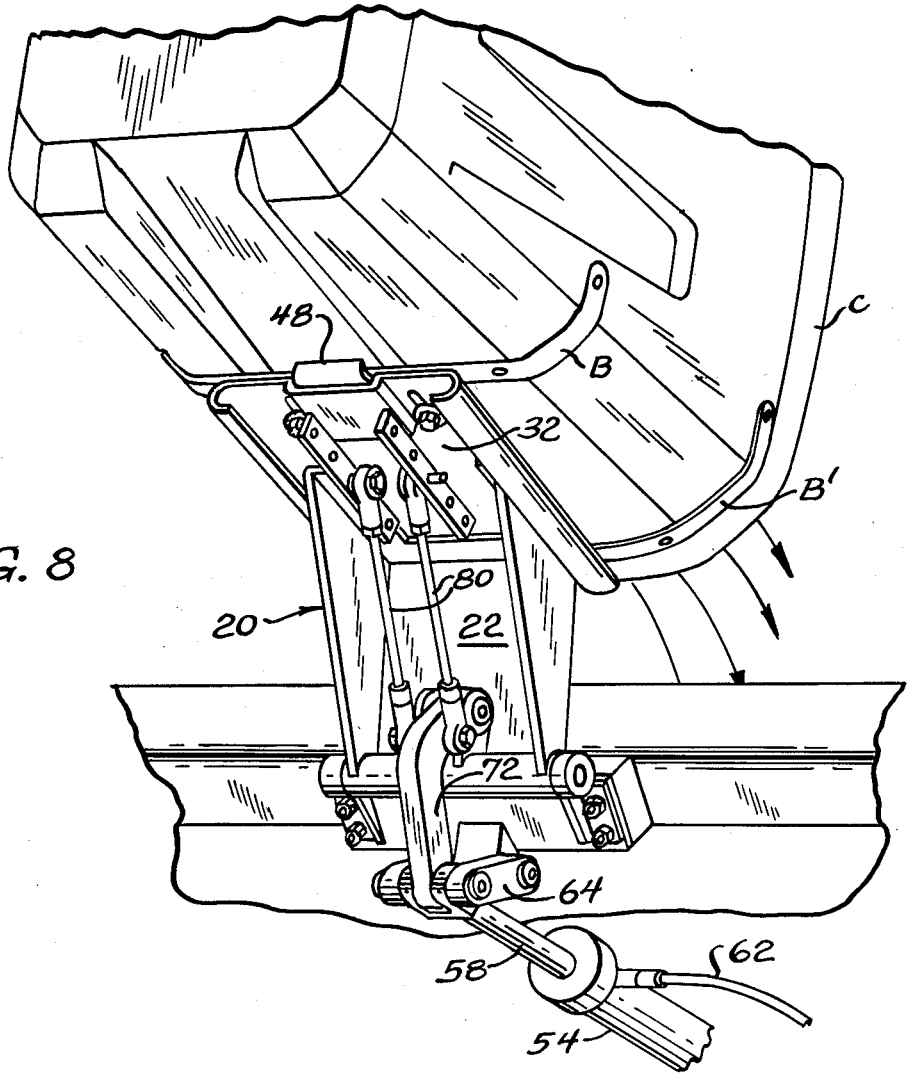

In operation, the lifter 20 is initially located in a first lower position beneath the vehicle V, as shown in FIG. 1. In this configuration, the hook 48 is spaced from the flange 42. Prior to use of the lifter 20, the container C of FIG. 3 is moved to a position behind the lifter 20. With reference to FIG. 6, as the cylinder 54 is operated by the pump 60 and motor 61 to drive the piston 58 out of the cylinder 54, the lifter 20 moves from beneath the truck and the hook 40 initially catches the upper bar B′ of the container C. With reference to FIG. 7, as the piston 58 is driven further from the cylinder 54, the lower bar B of the container C is received between the hook 48 and the flange 42. Next, as the cylinder 54 further drives the lifter 20 in an upward direction, the hook 48 moves toward the flange 42 in order to clamp the lower bar B of container C between the hook 48 and flange 42 and prevent the container C from falling into the cavity C′ of the vehicle V. Finally, with reference to FIG. 8, the lifter 20 is driven to a second upper position with the container C located above the cavity C′ of the vehicle V in an upside down orientation in order to empty the container C into the cavity C′ of the vehicle V. After the container C has been emptied into the vehicle V, the lifter 20 is driven from the second upper position to the first lower position while the hook 48 moves away from the flange 42 in order to release the lower bar B of the container C. In this manner, the lifter 20 of the present invention may be readily and simply used in order to empty the container C into the cavity C′ of the vehicle V.

Figure 9:
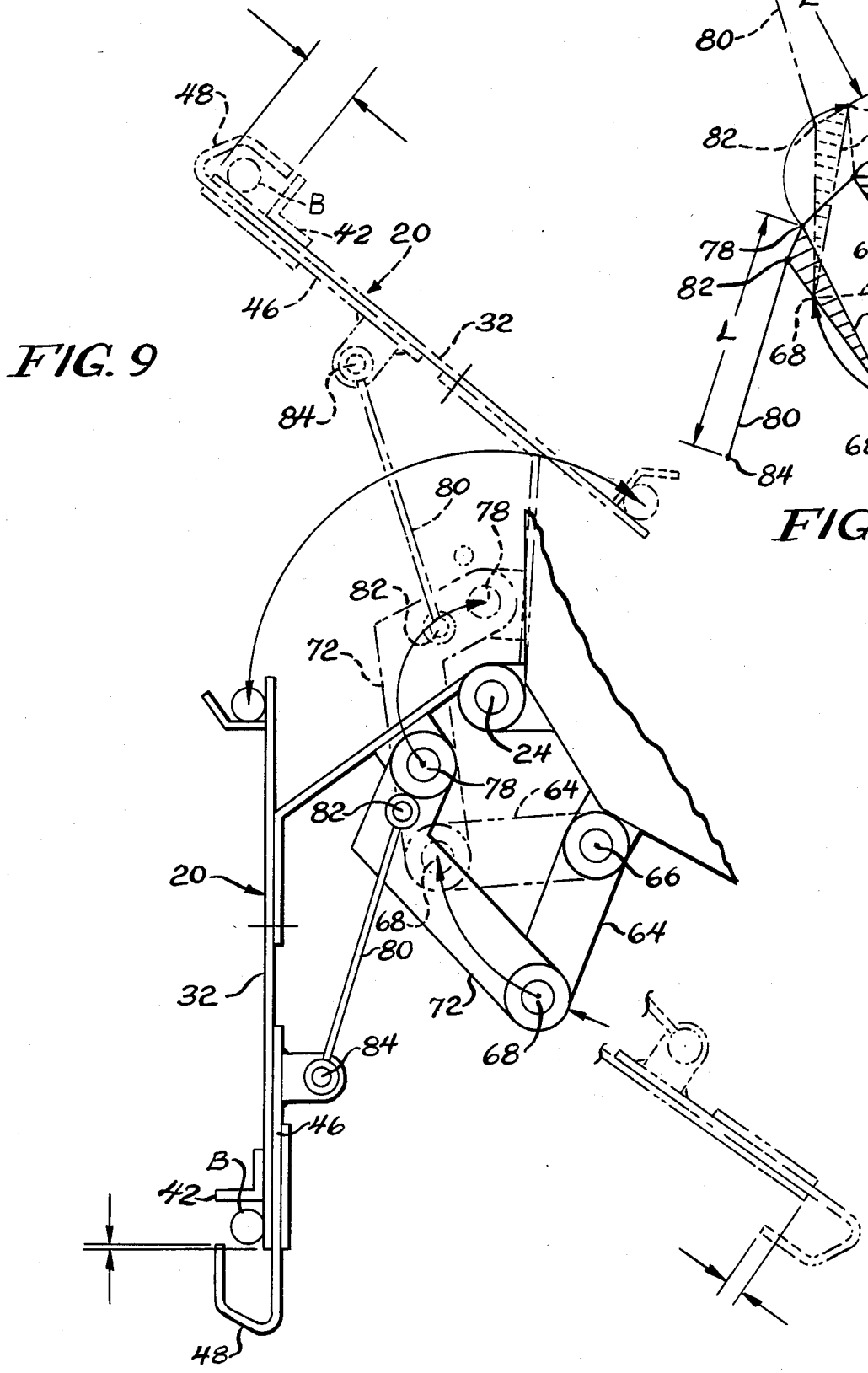
FIGS. 9 and 10 are diagrammatic views illustrating operation of the lifter of the present invention.
Figure 10:
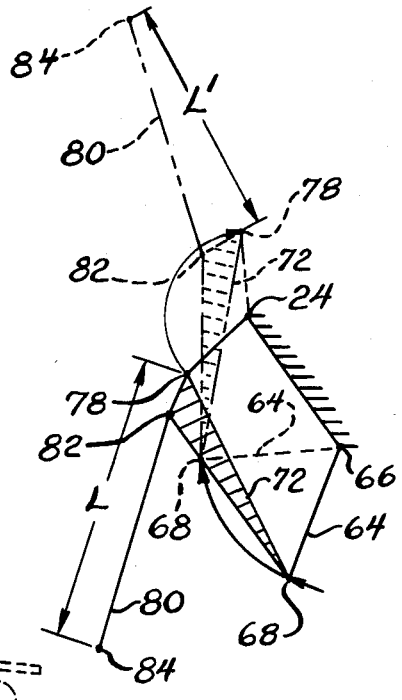

The manner in which the hook 48 is moved toward and away from the flange 42 during movement of the lifter 20 will be discussed in connection with FIGS. 9 and 10 where the lifter 20 is shown in solid lines in a lower position and in dotted lines in an upper position. As shown, the pivotal connections 78, 82, and 84 are located on nearly a straight line at the lower position of the lifter 20 and define a distance L between the connections 78 and 84. In the upper position of the lifter 20, the connections 78, 82, and 84 form a triangle to define the distance L′. Therefore, it will be apparent that the distance L′ between the connections 78 and 84 is less in the upper position of the lifter 20 than the distance L in the lower position of the lifter 20. Accordingly, the rods 80 pull on the tongue 46 as the distance between connections 78 and 84 lessens while the lifter 20 rises, and the tongue 46 moves the hook 48 over the bar B as the lifter 20 rises and the distance L shortens. In this manner, the hook 48 is clamped on the bar B as the lifter 20 moves toward its upper position. In a preferred form, the hook 48 clamps on the bar B when the lifter 20 is approximately in a horizontal position. In reverse, as the lifter 20 lowers from its upper position the distance L′ increases and the rods 80 move the tongue 46 and hook 48 toward an outer position in order to release the bar B. In this manner, the lifter 20 of the present invention clamps the bar B of the container C as the lifter rises to its second upper position in order to prevent the container from falling into the cavity C′of the vehicle as the container C is emptied.

As refuse is placed in the cavity C′ of the vehicle V, the vehicle V settles and the height of the hooks 48 and 40 may change with respect to the bars of the container C. Also, when the vehicle is placed on a hill, the height of the hooks 48 and 40 may change relative to the bars of the container C. In accordance with the present invention, the height of the hooks 48 and 40 may be adjusted relative to the bars B and B′ of the container C to accommodate these changes. The openings 36 and 38 of third plate 32 may be selectively positioned in register with the apertures 28 of the second plate 26 as the third plate 32 is slid relative to the second plate 26. Once the selected openings 36 and 38 are in register with the apertures 28, a pair of pins 86 are placed through the openings 36 and 38 and the apertures 28 in order to retain the third plate 32 in place relative to the second plate 26. Prior to adjustment of the third plate 32, the pins 84 of the rods 80 are removed from the apertures 52 of the flanges 50, and the pins 84 are then inserted into different apertures 52 of the flanges 50 depending upon the location of the third plate 32. Of course, the position of the hooks 48 and 40 are fixed with respect to the third plate 32, and thus the height of the hooks 48 and 40 are adjusted relative to the container C through adjustment of the position of the third plate 32 in the manner described.

Thus, in accordance with the present invention, the lifter 20 may be positioned beneath the vehicle V to permit access to the vehicle V and empty large rear loading containers into the vehicle V. Also, the lifter 20 grasps a container C during movement to a second upper position in order to empty the container C into the vehicle V. In accordance with the invention, the lifter 20 has a hook 48 which clamps on a bar B of the container C during upward movement of the lifter 20, in order to prevent the container C from falling into the cavity C' of the vehicle V as the container C is being emptied, and the hook 48 automatically releases the bar B of the container C as the lifter 20 moves from its upper to lower position. Also, the height of hooks 48 and 40 of the lifter 20 may be adjusted relative to the bars B and B' of the containers C such that the hooks 48 and 40 appropriately grasp the bars B and B' on the container C during operation of the lifter 20.

The foregoing detailed description is given for clearness of understanding only, and no unnecessary limitations should be understood therefrom, as modifications will be obvious to those skilled in the art.

We claim:

1. A lifter for emptying a container into a cavity of a vehicle, comprising:

a first plate;

means for pivotally mounting the first plate to the vehicle;

a second plate extending at an angle from the first plate and having a pair of spaced apertures extending therethrough;

a third plate slidably mounted on the second plate and having an outwardly directed first flange adjacent an outer end of the third plate, a tunnel adjacent the outer end of the third plate, and a pair of sets of spaced and aligned openings extending through the third plate and which may be selectively aligned with the apertures;

a pair of pins removably received through the aligned apertures and openings;

hook means comprising a tongue slidably received in the tunnel, and a hook member extending from one end of the tongue and being directed toward the first flange;

a pair of second spaced outwardly directed flanges connected adjacent an other end of the tongue, each of the second flanges having a plurality of spaced apertures aligned along the second flanges;

a cylinder having a piston;

at least one link arm having one end pivotally connected to the vehicle and an other end pivotally connected to an outer end of the piston;

an arcuate arm having one end pivotally connected to the other end of the link arm and an other end pivotally connected to the first plate; and a pair of rods each having one end pivotally connected to opposed sides of the arcuate arm intermediate the pivotal connections thereof, and each of the rods having a pair of pins adjacent an other end pivotally received in selected apertures of the second flanges.

2. The lifter of claim 1 including a second hook member connected adjacent an inner end of the third plate.

3. A lifter for emptying a container into a cavity of a vehicle, comprising:

a first plate;

means for pivotally mounting the first plate to the vehicle;

a second plate extending at an angle from the first plate;

a third plate slidably mounted on the second plate and having a first hook member adjacent an outer end of the third plate, and a second hook member adjacent an inner end of the third plate;

means to allow for adjustment of the position of the third plate relative to the second plate;

a cylinder having a piston;

at least one link arm having one end pivotally connected to the vehicle and an other end pivotally connected to an outer end of the piston; and an arcuate arm having one end pivotally connected to the other end of the link arm and an other end pivotally connected to the first plate.

4. The lifter of claim 3 in which said at least one link arm comprises a pair of aligned link arms each having one end pivotally connected to the vehicle and the other end pivotally connected to the outer end of the piston.

5. The lifter of claim 3 wherein the third plate includes a flange, and including means for releasably capturing a bar of the container between the first hook member and the flange.

6. The lifter of claim 3 including means for pivotally mounting the cylinder on the vehicle.

7. In a vehicular dumping apparatus having a cavity with a rearward facing opening for receipt of refuse into the cavity, said opening defined, in part, by a sill edge at a level above the ground to be engageable by an edge of a relatively tall, first type of container when the rear of the vehicle and the first type of container are moved relatively toward one another along the ground through a path of engagement at the rear of the vehicular dumping apparatus, said sill edge being adjacent to said container edge during tipping of the first type of container about said sill edge to empty its contents into the cavity, the improvement being a lifter assembly for emptying a relatively shorter second type of container, comprising:

means for releasably capturing the relatively shorter, second type of container when moved through the path of engagement at the rear of the vehicle;

means for mounting the capturing means to the rear of the vehicle for movement between a retracted position in which the capturing means is located in a relatively lowered forward position substantially beneath the vehicle and out of the path of engagement of the first type of container, and a series of relatively rearward operative positions in which it extends into the path of engagement of the first type of container to capture and lift the second type of container over the sill edge and dump the contents of the second type of container over the cavity; and means for selectively driving the movable mounting means between said retracted position and said series of operative positions.

8. The vehicular dumping apparatus of claim 7 in which the capturing means and the mounting means for said capturing means are substantially entirely located forwardly of said sill edge when in the retracted position.

9. The vehicular dumping apparatus of claim 7 in which said second type of container is substantially smaller and shorter than said first type of container and has an opening with the dimensions substantially less than the extent of said sill edge and said opening.

10. A method of collecting refuse in a rear loading cavity of a vehicular dumping apparatus from a plurality of different, first and second types of containers, said first type of container having an uppermost edge at a sufficient height to engage a sill edge defining a lowermost edge of a rearward facing opening to said cavity, when the first type of container is resting on common ground with the vehicular dumping apparatus, and said second type of container having an uppermost edge at an insufficient elevation to engage the sill edge when resting on when resting on common ground with the vehicular dumping apparatus, comprising the steps of:

moving the vehicular dumping apparatus and the first type of container toward each other across the common ground until the sill edge is engaged by the pivot edge of the first type of container;

tilting the first type of container about said sill edge to dump its contents into said cavity;

disengaging the first type of container and the vehicular dumping apparatus;

moving the vehicular apparatus and a second type of container toward one another across said common ground until the second type of container is at a loading location rearwardly adjacent and beneath the sill edge;

actuating a powered lifting device to move a grasping member rearwardly from a retracted position substantially beneath the vehicular dumping apparatus, in which it does not interfere with the engagement of a first type of container with the sill edge and is located relatively forwardly of the path of engagement, to a loading position located in the path of engagement;

grasping the second type of container at said loading position;

lifting the grasped second type of container to an elevated position in which its uppermost edge is not lower than said pivot support edge;

tilting the grasped second type of container when in said elevated position to dump its contents into the cavity;

returning the grasped second type of container to the loading location;

returning the lifting device to the relatively forwardly located retracted position in which the lifting device is out of the path of engagement and substantially beneath the vehicular dumping apparatus; and moving the vehicular dumping apparatus to the next container.

11. A refuse collection vehicle comprising:

means defining a refuse receiving cavity, including a lower sill edge and a bottom wall sloping upwardly toward said sill edge;

a container lifting pivotally mounted below said sill edge and movable between a first position fully below said sill edge to permit unobstructed access to said sill edge and a second position above said sill edge for dumping the contents of a container;

means for moving said lifter between said first and second positions;

said lifter further comprising a first projection fixedly attached to said lifter and a second projection movable relative to said first projection between a first position spaced from said first projection for receiving a container portion therebetween and a second position in closer proximity to said first projection for capturing the container portion therebetween; and means for moving said second projection between said first and second positions, said second projection moving means being cooperatively attached to said lifter moving means and to said second projection so as to move said second projection from said first to said second positions as said lifter moves from said first to said second positions;

an arcuate link pivotally carried by said lifter and said bottom wall and a second link pivotally attached at one end to said second projection and pivotally attached at the other end to said arcuate link, said second link being attached to said arcuate link at a location spaced from a line connecting the pivot points of the said arcuate link, said means for moving said lifter being pivotally attached to said arcuate link;

whereby said lifter is movable to the first position to permit unobstructed access to said sill edge and to the second position for capturing, lifting and dumping refuse containers.

12. A refuse collection vehicle in accordance with claim 11 wherein said second projection further comprises a plurality of spaced attachment points for selective attachment of said second link.

13. A refuse collection vehicle in accordance with claim 11 wherein said means for moving said lifter comprises a hydraulic cylinder and piston combination pivotally attached at one end to said bottom wall and pivotally attached at the other end to said arcuate link.

14. Receptacle dumping apparatus attachable to a refuse collection vehicle of the type having means defining a refuse receiving cavity including a lower sill, said dumping apparatus comprising:

a receptacle lifter;

means for pivotally mounting said receptacle lifter to a refuse collection vehicle;

means for moving said lifter between a first position below the sill and a second position above the sill for dumping a refuse receptacle;

said lifter including a first portion and a second portion carried by said first portion;

capture means including a pair of projections carried by said second portion and relatively movable between a first position for capturing a portion of a receptacle between said projections and a second position for releasing the receptacle portion;

said second portion of said lifter being movable relative to said first portion for selectively changing the height of said capture means relative to the ground for accommodating containers of various heights;

means for moving said capture means between said capture and release positions, said means for moving said capture means being cooperatively attached to said lifter moving means and to said capture means for moving said capture means from said release position to said capture position as said lifter moves from the first position to the second position and for moving said capture means from said capture position to said release position as said lifter moves from the second position to the first position;

said means for moving said capture means further including means for selectively changing a connection point of said means for moving said capture means to compensate for any adjustment in the height of said capture means.

15. Receptacle dumping apparatus in accordance with claim 14, wherein said second portion comprises a plate slidably mounted on said first portion, said pair of projections comprises a first projection fixedly attached to said plate and a hook-shaped projection movable toward and away from said first projection, and said means for selectively changing a connection point comprises means attached to said hook-shaped projection and defining a plurality of spaced apertures for selective adjustment of said means for moving said capture means.

16. Receptacle dumping apparatus in accordance with claim 14 further comprising a third projection carried by said second portion for engaging a different portion of the receptacle than said first and second projections.

17. Receptacle dumping apparatus attachable to a refuse collection vehicle of the type having a refuse receiving cavity including a lower sill edge, said apparatus comprising a receptacle lifter;

means for pivotally mounting said receptacle lifter to a refuse collection vehicle;

means for moving said lifter between a first position below the sill edge and a second position above the sill edge for dumping a refuse receptacle;

said lifter comprising a plate slidably mounted on another portion of said lifter, means for locking said plate in a selected one of a plurality of positions relative to said other portion of said lifter;

a hook slidably mounted on said plate and a first projection fixedly mounted on said plate, said hook being slidable between a capture position in which said hook and first projection are in sufficiently close proximity to capture a portion of a receptacle therebetween and a release position spaced from said first projection to release the container portion;

means for moving said hook between capture and release positions, said means for moving said hook being pivotally attached to said means for moving said lifter so as to move said hook between the capture and release positions as said lifter is moved between the second and first positions;

a second projection fixedly mounted on said plate for engaging a different portion of the receptacle; and means for mounting said hook moving means at a selected position on said hook.

18. A refuse collection vehicle in accordance with claim 11 furthers comprising a third link pivotally attached at one end to said bottom wall and pivotally attached at the other end to one end of said arcuate link.

* * * * *

UNITED STATES PATENT AND TRADEMARK OFFICE

CERTIFICATE OF CORRECTION

PATENT NO. : 4,741,658

DATED : May 3, 1988

INVENTOR(S) : Zelinka, et al.

It is certified that error appears in the above—identified patent and that said Letters Patent is hereby corrected as shown below:

In the specification: Col. 2 line 49

Delete "by tilting without lifting"

In the claims: Col. 7 line 47

Change "lifting" to--lifter--

Signed and Sealed this

Thirteenth Day of December, 1988

*Attest:*

DONALD J. QUIGG

*Attesting Officer*

*Commissioner of Patents and Trademarks*